United States Patent [19]

Bendall

[11] 4,188,837

[45] Feb. 19, 1980

[54] FUEL ECONOMIZING DRIVE SYSTEM FOR NAVAL AND MERCHANT SHIPS

[76] Inventor: Wilfrid H. Bendall, 48-18 43rd St., Woodside, N.Y. 11377

[21] Appl. No.: 961,883

[22] Filed: Nov. 20, 1978

Related U.S. Application Data

[63] Continuation-in-part of Ser. No. 944,265, Sep. 21, 1978.

[51] Int. Cl.[2] ..... F16H 37/06; F16H 11/00; B63H 5/08

[52] U.S. Cl. ..... 74/665 M; 74/665 GB; 74/665 GE; 74/661; 74/216.5; 115/37; 74/722

[58] Field of Search ..... 74/665 R, 665 F, 665 G, 74/665 GA, 665 GB, 665 GC, 665 GE, 722, 664, 661, 665 L, 665 M, 665 N, 665 P, 216.5; 114/269; 115/34 R, 34 C, 37, 63

[56] References Cited

U.S. PATENT DOCUMENTS

| | | | |
|---|---|---|---|
| 987,178 | 3/1911 | Schutte | 74/722 |
| 1,057,963 | 4/1913 | Herrmann | 74/216.5 |
| 1,089,029 | 3/1914 | Zimmermann | 74/661 X |
| 1,113,044 | 10/1914 | Orme | 74/722 |
| 3,112,728 | 12/1963 | Krause | 74/665 GB |
| 3,132,739 | 5/1964 | Jakobsson et al. | 74/665 GE X |
| 3,261,229 | 7/1966 | Thomas et al. | 74/665 GB |
| 3,315,860 | 4/1967 | Adams et al. | 74/661 X |
| 3,388,748 | 6/1968 | Jung | 74/661 X |
| 3,391,745 | 7/1968 | Svensson | 74/661 X |
| 3,922,997 | 12/1975 | Jameson | 115/34 R X |

*Primary Examiner*—Lance Chandler

[57] ABSTRACT

The system permits selective combining of one of a plurality of prime movers with a plurality of propeller shafts by means of a transverse chain drive between the propeller shafts to enable efficient multi-screw ship operation with one engine.

7 Claims, 2 Drawing Figures

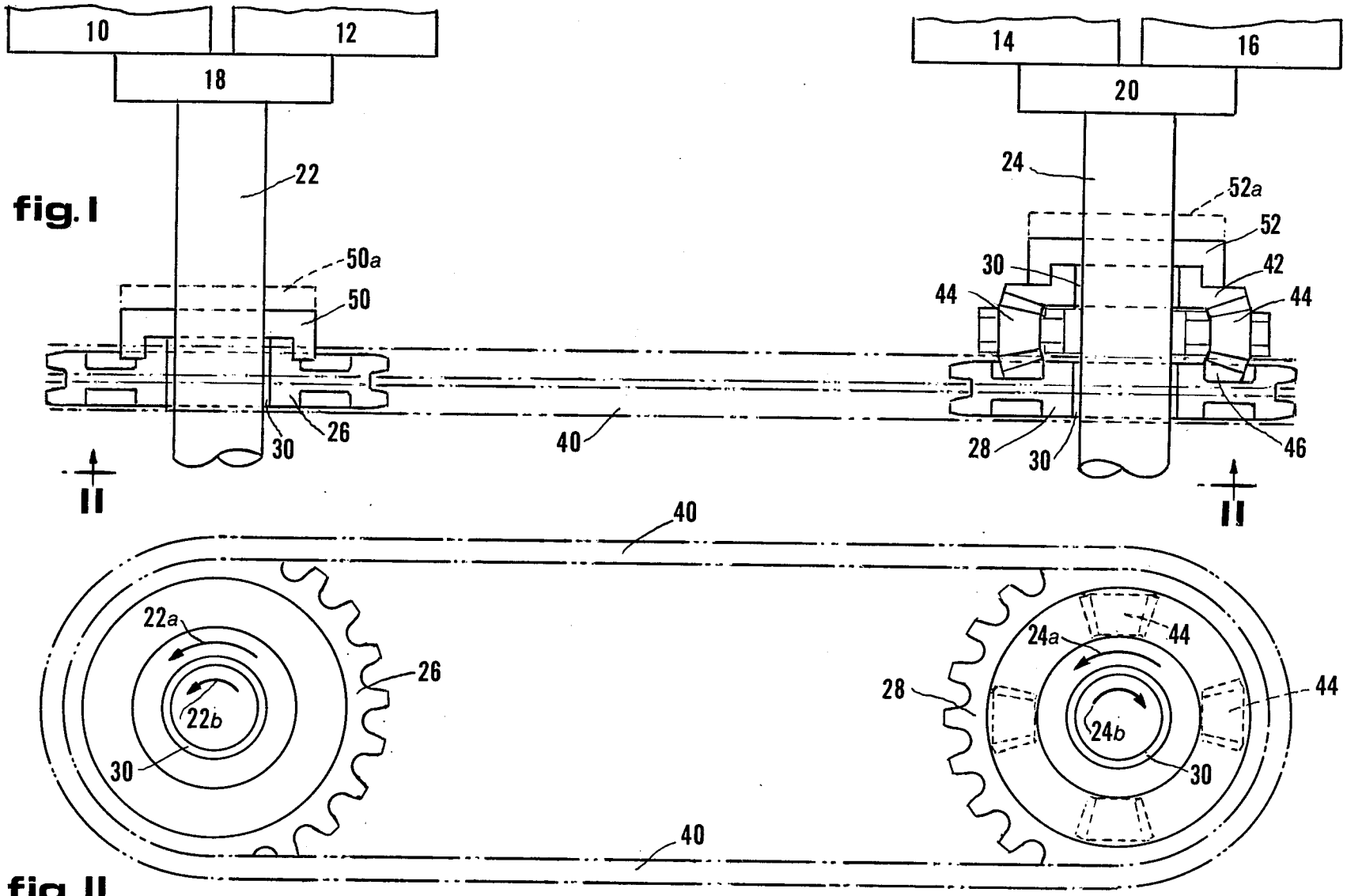
fig. I
fig. II

FUEL ECONOMIZING DRIVE SYSTEM FOR NAVAL AND MERCHANT SHIPS

BACKGROUND OF THE INVENTION

This application is a continuation-in-part of prior application Ser. No. 944,265, filed Sept. 21, 1978, and also relates to prior application Ser. No. 956,496, filed Nov. 1, 1978 by the present inventor.

RELATED APPLICATIONS

Ser. No. 944,265, filed Sept. 21, 1978.
Ser. No. 947,483, filed Oct. 2, 1978.
Ser. No. 956,496, filed Nov. 1, 1978.

1. Field of the Invention

This invention relates generally to mechanical drive systems and more particularly to a ship drive system for efficiently combining any one of a plurality of prime movers with a plurality of propeller shafts to enable economical multi-screw ship operation with limited power and fuel consumption.

For over a decade prior to the present time naval and merchant ship operators have been cognizant of the need for a drive system that would enable efficient transmission of a limited part of a high power multi-engine installation in twin-screw vessels. The energy crisis and the fuel shortage have combined to make this need increasingly acute, particularly for naval requirements which involve continuous ship operation at limited speeds for extended periods of time.

2. Description of the Prior Art

Prior art proposals for meeting this need comprise use of supplementary low power "cruise" engines additional to the main power plant or, alternatively, proposals to employ more easily controlled electric or pneumatic drive systems, or waste heat recovery systems—all of which generally involve weight, efficiency and cost penalties which tend to negate the purpose. So called "cross-connect" drive proposals envision use of transverse shafts or gear systems to divide the power of one engine equally between two shafts and propellers. Since a rigid ship hull is virtually impossible of attainment and ship hulls normally are subject to sea forces which impose large hogging, sagging and torsional hull strains, the problem of maintaining alignment between rigid drive components athwart flexible hulls presents intractable transmission difficulties.

The energy crisis naturally has highlighted the need for a solution to this ship drive problem. Computation of the fuel requirements of a 7,800 ton destroyer type ship, for example, indicates that a fuel saving of over 6,300 gallons of oil per day, per ship, would be realized with an efficient cross-connect drive system. When this potential saving per ship is multiplied by the number of such vessels projected and now under construction, plus that of worldwide merchant ship operations, the energy conservation potential of an efficient cross-connect transmission system is seen to be substantial.

SUMMARY OF THE INVENTION

The drive system of the present invention utilizes high capacity sprocket drive chains. The chain drive, in principle, is well adaptable for this purpose owing to its inherent ability to accommodate hull flexure and drive misalignment over widely spaced drive centers. It also is relatively resilient, compact and light in weight per transmitted horsepower. The basic roller chain configuration is conveniently versatile in its adaptabilty to operation with reverse flexure sprocket engagement and in its self-retention on the sprockets. It should be noted, however, that direct application of the industrial standard roller chain for the present purpose would result in an impractically wide and heavy installation. It therefore should be noted that the roller type chain's advantages for this purpose can be retained by modifying its design to incorporate the well known rocker-joint bearing principle in its construction. A high power transmission capacity roller chain of this latter type is disclosed in U.S. Pat. No. 3,540,302, issued Nov. 17, 1970 to the present inventor and in a more recent patent application having Ser. No. 947,483, filed Oct. 2, 1978. This enables reduction of the overall width of the drive to less than one-fourth that of the standard chain for equal power transmission capacity. It also enables a drive system limited to two drive sprockets engaged by a single chain length, as disclosed in the present invention.

From the foregoing remarks it can be properly inferred that a primary object of the present invention is to provide a mechanically efficient and compact drive system particularly adapted to the requirements of naval and merchant ships; a system enabling substantial operating economies, of low weight per transmitted horsepower and low cost, and with low maintenance requirements; also, a ship drive system relatively quiet and vibrationless in operation and adapted to accommodate hull deformations by virtue of an inherently elastic drive characteristic. These and other objects and advantages of the drive system set forth herein will be apparent to those knowledgeable in the art following reference to the accompanying description, drawing figures and claims of this specification.

THE DRAWINGS

FIG. I is a schematic diagram in transverse plan view of the drive system of this invention.

FIG. II is an end elevational view on the line II—II of FIG. I.

THE PREFERRED EMBODIMENT

In FIG. I, reference numerals 10, 12, 14 and 16, respectively designate a plurality of separately controllable prime movers such as gas or steam turbines, or diesel engines, each connected to combining reduction gear units 18 and 20 and, through the latter, to oppositely rotating propeller shafts 22 and 24 driving screw propellers (not shown). Chain drive sprockets 26 and 28 are mounted in initially free rotation on bearings 30, on the propeller shafts. Reference numeral 40, in FIGS. I and II, designates a drive chain extending athrwartships and interconnecting the sprockets. The chain preferably is of the general roller chain type modified as described in the foregoing text. In practice, for the relatively high horsepower transmission required for such ship drives the chain would comprise a double or triple integral width link assembly and the drive sprockets would have a relatively larger tooth number than shown diagrammatically in FIG. II. As a specific example, a drive of the type exemplified, transmitting about 10,500 horsepower, would use a 3" pitch chain engaging 54-tooth sprockets of approximately 52" pitch diameter.

Twin screw ship propulsion systems normally require opposite rotation of the propeller shafts, as indicated in FIG. 11 by arrows **22*b* and 24*b*, for balanced propeller torque reaction. Since the two-sprocket, single chain drive requires equal directional rotation of the sprockets the opposite rotation of sprocket 28 relative to shaft 24 is effected by the bevel gear 42 mounted in initially free rotation on bearing 30 on the propeller shaft and interconnected through bevel pinions 44, 44 to bevel gear 46 mounted on the hub of sprocket 28** for driving connection therewith.

The drive system of this invention, initially in free rotation on the propeller shafts, is disengageably connected to the latter by conventional clutch members 50 and 52. In practice, for example, clutch member 50 would be in slidably splined engagement with propeller shaft 22 and a hub portion of sprocket 26. Similarly, clutch member 52 would be slidably splined to propeller shaft 24 and a hub portion of bevel gear 42. It will be understood that these clutch members customarily would be simultaneously actuated by conventional hydraulic, pneumatic or electrical means to effect total drive engagement with, and disengagement from, the propeller shafts. Shifting the clutch members to the positions indicated by dotted outlines 50*a* and 52*a*, respectively, effects disengagement.

With the arrangement thus described single engine power applied to either propeller shaft is transmitted to the opposite propeller shaft with opposite rotation and with a substantially equal division of power between the two shafts.

What is claimed is:

1. A ship drive system for connecting any of a plurality of selectively controllable prime movers to a plurality of propeller shafts, said system comprising selectively controllable drive means connecting the prime movers to parallel, oppositely rotating propeller shafts each having a drive sprocket mounted thereon, said sprockets being interconnected by a drive chain extending transversely therebetween, one of said shafts having coaxial sprocket rotation reversing means mounted thereon for rotating its sprocket in a direction opposite from that of the propeller shaft on which it is mounted.

2. The ship drive system of claim 1 wherein said rotation reversing means comprise coaxial bevel gears interconnected by bevel pinions, one of the bevel gears being connected to a sprocket and the other bevel gear being connected to a propeller shaft.

3. The ship drive system of claim 2 wherein clutch means control driving connection of one of said bevel gears and one of said sprockets to a propeller shaft.

4. The ship drive system of claim 1 wherein each of said sprockets is mounted in initially free rotation on the propeller shafts.

5. The ship drive system of claim 1 wherein prime mover power selectively applied for rotation of one of the propeller shafts in a given direction transmits a substantially equal portion of the power to an adjacent propeller shaft with rotation in an opposite direction.

6. The ship drive system of claim 1 wherein the propeller shafts have opposite directional rotation and the rotational direction of the drive sprockets and chain is identical.

7. The ship drive system of claim 1 wherein the propeller shafts are connected to the system by disengageable clutch means.

* * * * *